United States Patent [19]

Moore

[11] 4,161,444

[45] Jul. 17, 1979

[54] MECHANICAL MEANS FOR INCREASING THE GRADE OF A FLOTATION CELL CONCENTRATE

[75] Inventor: Donald C. Moore, New Berlin, Wis.

[73] Assignee: Allis-Chalmers Corporation, Milwaukee, Wis.

[21] Appl. No.: 854,900

[22] Filed: Nov. 25, 1977

[51] Int. Cl.[2] ..... B03D 1/20

[52] U.S. Cl. ..... 209/169; 210/221 R; 261/93

[58] Field of Search ..... 209/164–165, 209/168–170; 210/221 R, 221 M; 261/93, 122

[56] References Cited

U.S. PATENT DOCUMENTS

| | | | |
|---|---|---|---|
| 1,398,394 | 11/1921 | Robbins | 210/221 P |
| 1,731,779 | 10/1929 | Houston | 209/170 |
| 2,104,349 | 1/1938 | MacCamy | 209/169 |
| 2,178,239 | 10/1939 | McKenna | 209/170 |
| 2,433,592 | 12/1947 | Booth | 209/168 |
| 2,973,095 | 2/1961 | Anderson et al. | 209/169 |
| 3,872,010 | 3/1975 | Nagahama | 209/169 |
| 4,028,229 | 6/1977 | Dell | 209/164 |

FOREIGN PATENT DOCUMENTS

| | | | |
|---|---|---|---|
| 96217 | 10/1923 | Austria | 209/169 |

*Primary Examiner*—Tim R. Miles
*Assistant Examiner*—Jon E. Hokanson
*Attorney, Agent, or Firm*—Robert C. Jones

[57] ABSTRACT

A flotation cell having a submerged screen for breaking up mineral-laden air bubbles to reduce refuse entrainment and a rotating rake to break up the surface froth to return mechanically entrapped refuse which has escaped the screen.

1 Claim, 2 Drawing Figures

MECHANICAL MEANS FOR INCREASING THE GRADE OF A FLOTATION CELL CONCENTRATE

BACKGROUND OF THE INVENTION

Flotation apparatus and processes respond to changing conditions resulting from depletion of high grade material sources, such as coal, along with a rising demand for the material. Also, rising cost factors have increased attempts to expand the production ability of the flotation apparatus. It has been found that in the removal of the desirable materials from a slurry, it is important to mechanically treat a mass of fine air bubbles to effect a release of entrapped, unwanted material. Each flotation machine is designed to accomplish different flotation functions. Prior apparatuses of the flotation type have had some serious disadvantages. For example, prior apparatuses of relatively good efficiency have been complicated in construction, which resulted in higher cost both in assembly and in disassembly for maintenance purposes. On the other hand, apparatuses of simpler construction have not been efficient thereby increasing production cost and requiring the installation of more units for a given production requirement. All prior apparatus which produce air bubbles do not, as far as it is known, treat the air bubbles so as to remove, unwanted entrapped materials.

It has been found that the production of a mass of fine air bubbles with low rotation of the agitator, while efficient for the most part in the removal of unwanted gangue from a coal slurry mixture, has not been able to remove the entire mechanically trapped portions of gangue.

SUMMARY OF THE INVENTION

The mass of fine air bubbles in a flotation cell progresses upwardly from the bottom of the cell. The closely massed air bubbles mechanically trap unwanted gangue between them, which is carried upwardly with the bubbles and would normally discharge with the froth to which the coal fines are attached. To effectively remove mechanically trapped gangue from the rising bubbles, a screen is fixed within the flotation cell. Thus, the rising bubbles pass through the screen and the mechanically trapped gangue is stripped from the bubbles. In addition, a rotating rake structure at the top of the cell above the fluid bed is provided to breakup the flocculent prior to the froth spilling over the discharge chute. This additional treatment of the air bubble mass imparts a mechanical motion to the air bubbles rolling the froth back into the solid pulp below the froth layer. This has the effect of washing any heavier gangue material out of the returned air bubbles.

It is the general object of the present invention to provide mechanical means for dislodging unwanted, trapped gangue from the mass of coal bearing bubbles in a flotation cell.

Still another object of the present invention is to provide a flotation cell with a submerged screen to breakup mineral-laden air bubbles to decrease refuse entrainment.

Yet another object of the present invention is to provide a mechanical means for breaking up coal froth in a flotation cell to effect a release of refuse particles mechanically trapped between the air bubbles.

DESCRIPTION OF THE INVENTION

Figure 1:
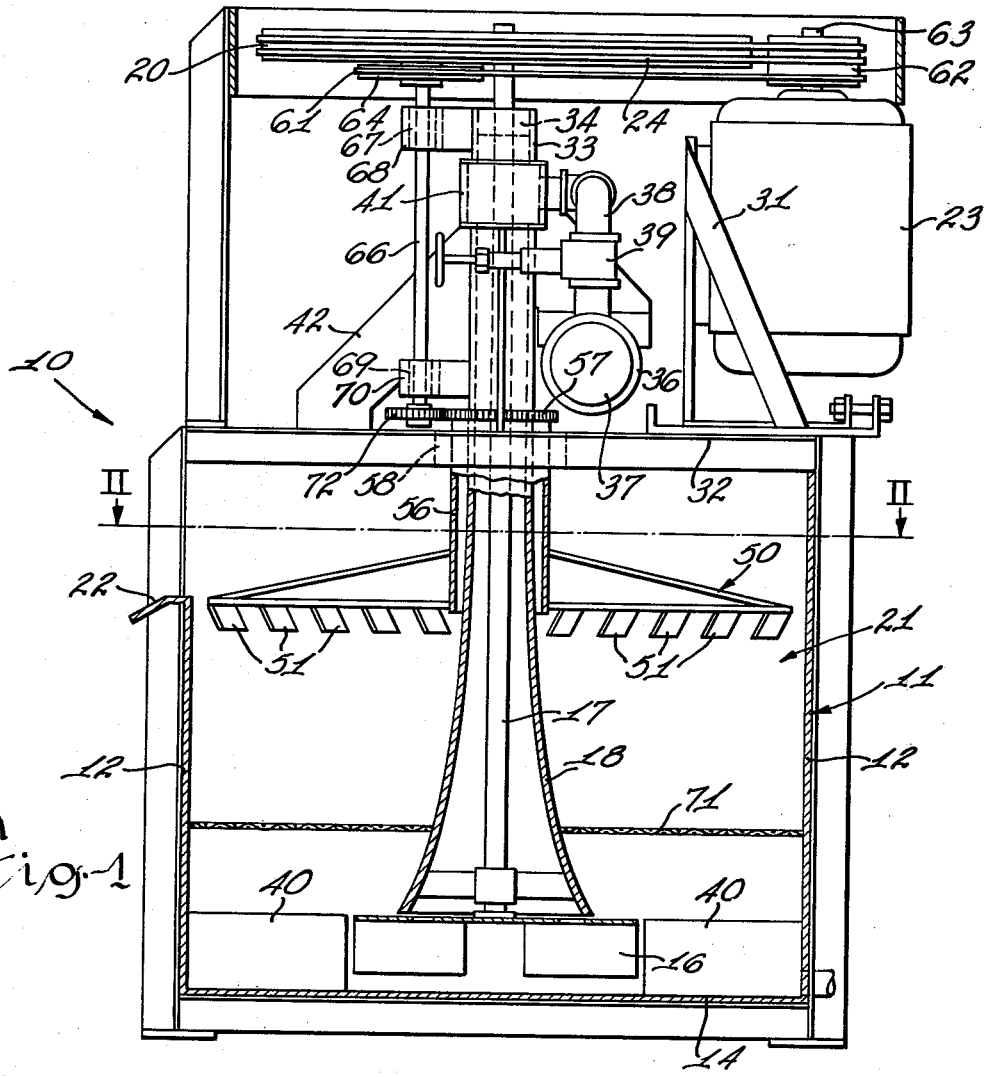
FIG. 1 is a view partly in vertical section and partly in elevation showing the interior of a flotation cell in which the present invention is incorporated.

The illustrated flotation apparatus 10 includes a tank 11 formed by side walls 12 and a bottom wall or base 14. The apparatus 10 includes an agitator 16 which is fixed to the depending end of a drive shaft 17 for rotation about the vertical axis of the shafts. The shaft 17 extends downwardly through a hollow air pipe 18, the lower end of which is bell shaped to provide a relatively large air zone towards the floor or bottom of the cell. Thus, air supplied through the pipe 18 is agitated by the agitator 16 so as to form small air bubbles which are capable of accumulating coal particles and carry these particles with them as they move upwardly into the froth zone. The froth spills out of the cell over a lip portion 22.

The shaft 17 is power driven by operation of a motor 23 driving through a belt transmission 24 operatively connected to a sheave 20 that is keyed to the upper extending end of the shaft 17. The motor 23 is carried by a bracket 31 which is mounted on the top structure 32 of the tank 11.

The upper end 33 of the air pipe 18 extends upwardly above the top of the tank 11 and encompasses the upper end of the drive shaft 17. A bearing 34 supported within the upper end 33 of pipe 18 gives support to the shaft. For supplying air to the pipe 18, there is provided an air compressor 36 operated by a motor 37. The compressor 36 is connected by suitable piping 38 and a regulating valve 39 to a manifold 41 which surrounds the upper end 33 of pipe 18. A bracket 42 upstanding from the top of the tank 11 supports the upper end 33 of the pipe 18 and previously mentioned related components. With the arrangement set forth, air from the compressor 36 is directed through the regulating valve 39 and into the manifold 41 by means of suitable openings (not shown) into the interior of pipe 18.

Extending radially about the bell-shaped pipe 18 are a plurality of diffuser plates 40 which are secured to the side walls and the bottom of the tank 11. As the agitated air bubbles pass from under the bell of the pipe 18, the mass is diffused by the plates 40.

As mentioned, the mass of air bubbles produced by agitating the air supplied to the bottom of the tank 11 through the bell-shaped pipe 18 pickup coal particles. However, it is also true that unwanted refuse particles are mechanically trapped between adjacent air bubbles. The unwanted refuse rises with the coal-carrying air bubbles and normally spills out over the discharge lip 22 along with the coal. This discharge must be processed in an additional step to remove the unwanted refuse from the desirable coal product. To eliminate a substantial portion of the unwanted refuse particles from the froth prior to the froth discharging over lip 22, a slowly rotating mechanical rake 50 is provided.

The bubbles in the top froth layer 21 have a very limited horizontal velocity. Thus, of themselves they cannot operate to separate so as to effect a dropout of the mechanically trapped refuse particles. By operation of the slowly rotating rake 50, a rolling mechanical motion is imparted to the bubbles so that the froth is rolled back into the low solid pulp below the froth layer. Thus, any heavy refuse particles are washed out of the returned air bubbles. This maintains the coal yield of the cell and, at the same time, reduces the refuse yield thereby increasing the overall coal grade of the cell.

Figure 2:
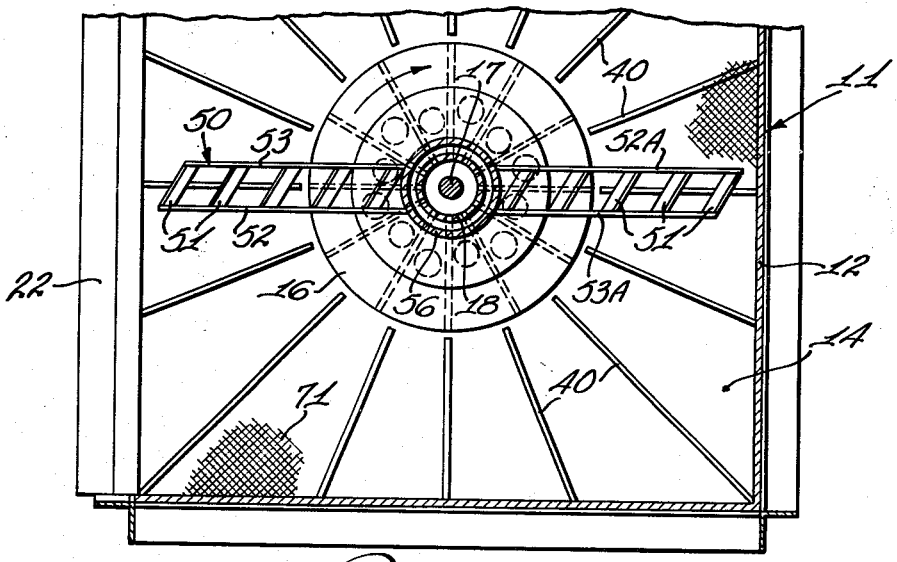
FIG. 2 is a view taken in a plane represented by the line II—II showing the froth-raking device of the present invention.

As shown, the rake 50 includes a plurality of teeth members 51 which are in the form of plates. The teeth 51 are arranged in depending relationship in ladder-like configuration from spaced-apart rail members 52 and 53. The teeth 51 are angularly disposed between the rails 52 and 53 and are also slanted inwardly towards the axis of rotation. This particular teeth arrangement has been found to provide the optimum rollover effect that is required to return the froth bubbles into the low solid pulp below the froth layer. As is shown in FIG. 2, there are two teeth-carrying arm extensions which are welded to a tubular rake drive extension member 56. The drive extension member 56 surrounds the air pipe 18 and is free to rotate relative to the pipe. As is shown, the drive extension 56 extends upwardly above the top surface of the tank and is supported for rotation by means of a suitable bearing 58.

To effect rotation of the tubular drive extension 56 and thereby the rake 50, a gear 57 is mounted about and secured to the drive extension 56. Power for driving the gear 57 is obtained from the motor 23 which is operatively connected to supply power to the gear. To this purpose a belt transmission 61 is entrained over the output sheave 62 secured to the motor output shaft 63. The belt 61 is entrained around a smaller sheave 64 which is secured to the upper end of a transmission shaft 66. Shaft 66 is journalled in a bearing 67 carried in an outboard supporting bracket 68 attached to the upper end of pipe 18. The lower end of the shaft 66 is journalled in a bearing 69 carried by a lower outboard bracket 70 also secured to pipe 18. At the lower end of shaft 66, a gear 72 is secured and is disposed in meshing engagement with the gear 57. Thus, the motor 23 is operatively connected to drive both the agitator 16 and the rake 50. If so desired, clutches may be utilized to drivingly connect the sheaves 20 and 64 to the shaft 17 and the shaft 66 respectively.

In addition to the rake 50 arrangement, there is an additional mechanical means for removing mechanically trapped refuse particles from the air bubbles as the air bubbles move upwardly. To this end, a screen 71 which is preferred to be between 4 and 10 mesh is secured to the sides of the tank 11. The screen 71 is approximately equal to the area of the bottom of the tank; with this, the air bubbles moving upwardly pass through the screen 71; and in so doing, mechanically trapped refuse particles are scraped from the air bubbles. This action relieves the air bubbles of a considerable amount of entrapped refuse and the remaining refuse particles are removed by action of the rake 50.

The embodiments of the invention in which an exclusive property or privilege is claimed are defined as follows:

1. In a flotation cell for treating coal slurry which contains unwanted refuse particles:

a tank in which the coal slurry is contained;

air supply means arranged to deliver air to the bottom of the tank to infuse fine air bubbles into the slurry;

a power driven agitating means carried by the tank and operatively arranged to disperse the fine air bubbles through the slurry; and, a mechanical power driven froth agitator carried by the tank, said froth agitator comprising a rake having a plurality of spaced-apart depending teeth which are disposed radially with respect to the axis of rotation of the rake and at an angle with respect to a horizontal line that passes through the axis about which the rake rotates, said teeth slanting inwardly towards the axis of rake rotation, said rake being disposed in position to impart a rolling mechanical motion to the froth layer so that the froth is rolled back into the low solid pulp below the froth layer so as to dislodge unwanted refuse particles mechanically trapped between air bubbles.

* * * * *